US007090101B2

(12) United States Patent
Engelman

(10) Patent No.: US 7,090,101 B2
(45) Date of Patent: Aug. 15, 2006

(54) SHOE DONNING AID

(76) Inventor: Ian K. Engelman, 3 Rhonda Dr., Scarborough, ME (US) 04074

( * ) Notice: Subject to any disclaimer, the term of this patent is extended or adjusted under 35 U.S.C. 154(b) by 480 days.

(21) Appl. No.: 10/712,167

(22) Filed: Nov. 13, 2003

(65) Prior Publication Data

US 2005/0103812 A1 May 19, 2005

(51) Int. Cl.
*A47G 25/80* (2006.01)

(52) U.S. Cl. ..... 223/113
(58) Field of Classification Search ..... 223/1, 223/111–119; 36/138
See application file for complete search history.

(56) References Cited

U.S. PATENT DOCUMENTS

| | | | | |
|---|---|---|---|---|
| 396,411 | A * | 1/1889 | McKenty | 223/119 |
| 1,523,850 | A * | 1/1925 | Zoll | 223/119 |
| 5,655,693 | A * | 8/1997 | Engelman et al. | 223/119 |
| 6,698,630 | B1 * | 3/2004 | Maguire | 223/118 |
| 2002/0008124 | A1 | 1/2002 | Runge | |
| 2002/0066213 | A1 * | 6/2002 | Wells | 36/138 |

* cited by examiner

*Primary Examiner*—John J. Calvert
*Assistant Examiner*—Andrew W. Sutton
(74) *Attorney, Agent, or Firm*—Shalom Wertsberger; Saltamar Innovations

(57) ABSTRACT

A shoe donning device is provided comprising a generally U shaped body 20, having an external portion 22 and an internal portion 24 extending downwardly from a top portion 26. The external portion having a top region, and spaced from said internal region for preventing said body from migrating forwardly from the rear of the shoe. The internal portion has an internal top region, and an internal bottom region which has at least one upwardly extending slot 50 cut in its rear region. Two side extensions extend forwardly from the rear portion and have grip enhancers to provide positive engagement between the shoe and the device. Each of the side extensions has a finger grips coupled to its upper side. The rear portion of the internal region is forwardly biased. The device is made of resilient, smooth, semi rigid material, such as molded plastic.

15 Claims, 3 Drawing Sheets

SHOE DONNING AID

FILED OF THE INVENTION

This invention relates generally to aids to donning shoes, and more particularly to a shoe donning aid adapted to fit inside a shoe prior to foot entry.

BACKGROUND OF THE INVENTION

For people with motion limitations the simple everyday task of donning one's shoe is often a daunting task. People with back problems, people that suffered a stroke and even some overweight people find the task difficult. Sometimes, a second person is required to achieve the task, which detracts from personal independence and contributes to feeling of inadequacy.

Several attempts have been made to resolve the problem. The age old solution of a shoehorn is well know but is often impractical: a short shoehorn requires the extended reach, while a long shoehorn is bulky and requires the use of at least one hand. Additionally, oftentimes the person required to use the shoehorn suffers from other dexterity problems that makes the task difficult. Specialized devices exist that are based on various implementations of an 'extended hand': an actuator placed at the end of an elongate rod, and operable by the person. This type of solutions are not as safe because they require the use of at least on hand and require twisting of the upper body (which can jeopardize balance). In addition these other solutions are relatively bulky and tend to be costly to produce.

In U.S. patent application publication Ser. No. 2002/0008124, published Jan. 24, 2002, Runge teaches a shoe chute comprising semi rigid material which fits over the back of the shoe and forms an internal "chute" which guides the foot into the shoe. The device has a body formed generally into a U shape which is slipped into the opening of the shoe, where the portion that extends into the shoe is angled slightly forward towards the front of the shoe. The outside portion is formed substantially parallel to the rear portion and parts of the sides of the shoe upper. However the Runge's device still presents some unresolved problems. Primary amongst them is a difficulty to insert the device into the shoe, an apparent narrowing of the shoe by the device, a tendency of the front of the device to 'climb' out of the shoe during foot insertion, and removing the device when the leg is inside the shoe are hard.

There is therefore a clear and unresolved need for a show donning device that will allow easy insertion of a foot into a shoe, operable by persons with motion limitations, and allowing easy removal of the device once the foot is inserted in the shoe.

SUMMARY OF THE INVENTION

In order to resolve the problems outlined above, there is disclosed a shoe donning aid comprising a generally U shaped body 20, having an external portion 22 and an internal portion 24 extending downwardly from a top portion 26. The external portion having an external top region, and spaced from said internal region for preventing said body from migrating forwardly from the rear of the shoe. The internal portion has an internal top region, and an internal bottom region which has at least one upwardly extending slot 50 cut in its rear region. Two side extensions 21 and 29 extend forwardly from the rear portion. Preferably, each of the side extensions has a prehensile finger grip 200 coupled to its upper side. Further preferably, the rear portion of the internal region is forwardly biased. Most preferably, the device is made of resilient, smooth, semi rigid material, such as molded plastic.

Optionally, the side extensions 21 and 29 further having forward edges 100 wherein said forward edges comprise grip enhancements 250 for enhancing the holding of the device within the shoe as a foot is inserted therein. The grip enhancements may comprise a hook, formed as a stepped edge 90 for engaging a stitch or a contour at the top of a shoe, or serrations 95 in the forward edge, or a friction element coupled to the internal portion of said side extension, or formed therein, and acting to increase friction between the device and the shoe. A combination of grip enhancements may also be utilized.

Preferably, the shoe donning device further comprises an extraction tab 40 downwardly depending from said rear portion of said external top region and extending downwardly below said internal bottom region.

Also preferably, the shoe donning device comprises at least one offset leverage protrusions 30 molded or formed in said external portion 22, and extending outwardly sideways from the rear region to form an extraction point.

Therefore in a preferred embodiment, the invention provides for a shoe donning aid comprising a generally U shaped body 20, having an external portion 22 and an internal portion 24 depending downwardly from a top portion 26. The external portion being spaced from the internal portion, said body constructed to permit its placement on a rear part of a shoe so that said internal portion, or a portion thereof, lies within the shoe, and said external portion, or a portion thereof, lies outside of the shoe, and the counter of the shoe protrudes between said external portion and said internal portion for preventing said body from migrating forwardly from said rear of the shoe. The body also having a rear region 23 and two side extensions 21 and 29, each of the side extensions having at least one prehensile finger grip 200, for aiding in placing the shoe donning aid into a shoe.

Preferably, each of said side extensions further has at least one forward edge, comprising a grip enhancer or enhancers, for enhancing the holding of the device within the shoe as a foot is inserted therein. The grip enhancer may comprise a stepped edge for engaging an internal seam or contour at the top of a shoe opening. Alternatively, or in combination, the grip enhancer may comprise serrations, protrusions or friction elements in said forward edge. Most preferably, the grip enhancer is outwardly biased. Preferably, the shoe donning device body or a portion thereof is made of resilient material.

In a preferred embodiment, the rear portion of the internal region is forwardly biased. Further, the internal portion preferably has at least one upwardly extending slot disposed therein.

SHORT DESCRIPTION OF DRAWINGS

The present invention may be better understood in light of the accompanying drawings in which.

DETAILED DESCRIPTION

Figure 1:
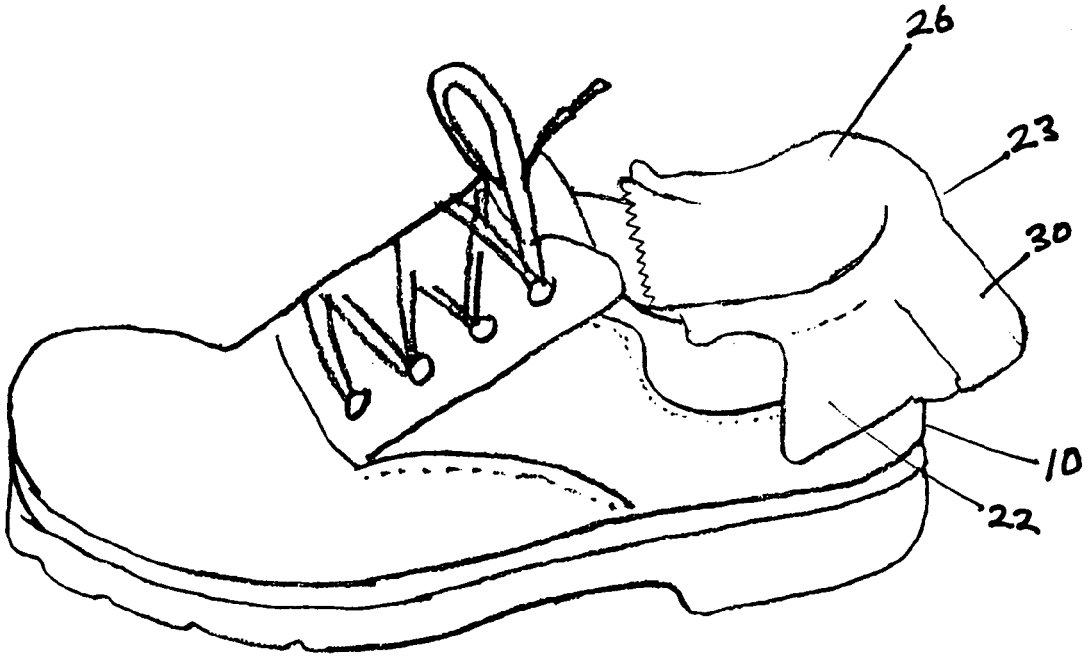
FIG. 1 depicts a shoe with the preferred embodiment of the invention inserted therein.
Figure 2:
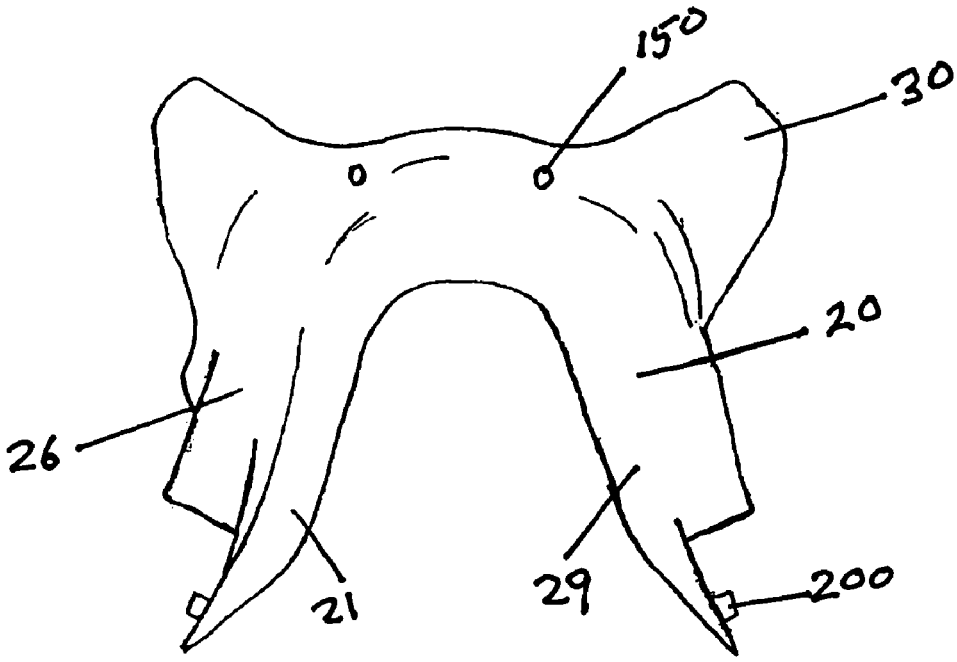
FIG. 2 depicts a top view of a preferred embodiment of the invention.
Figure 5:
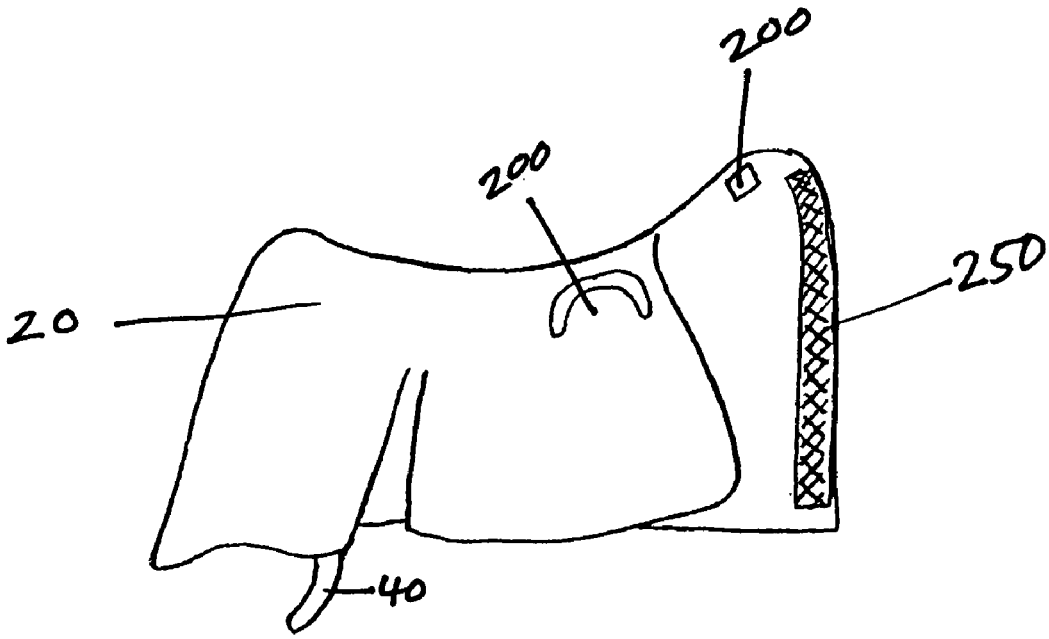
FIG. 5 is a side view of the device according to a preferred embodiment of the invention.
Figure 4:
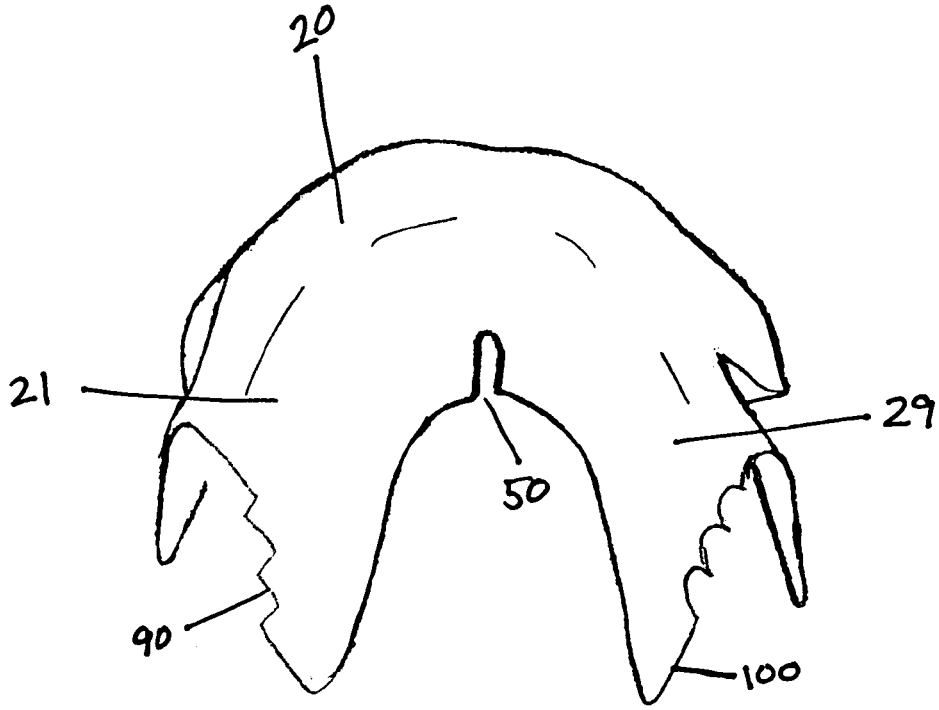
FIG. 4 is a top isometric view of a preferred embodiment of the device.
Figure 3:
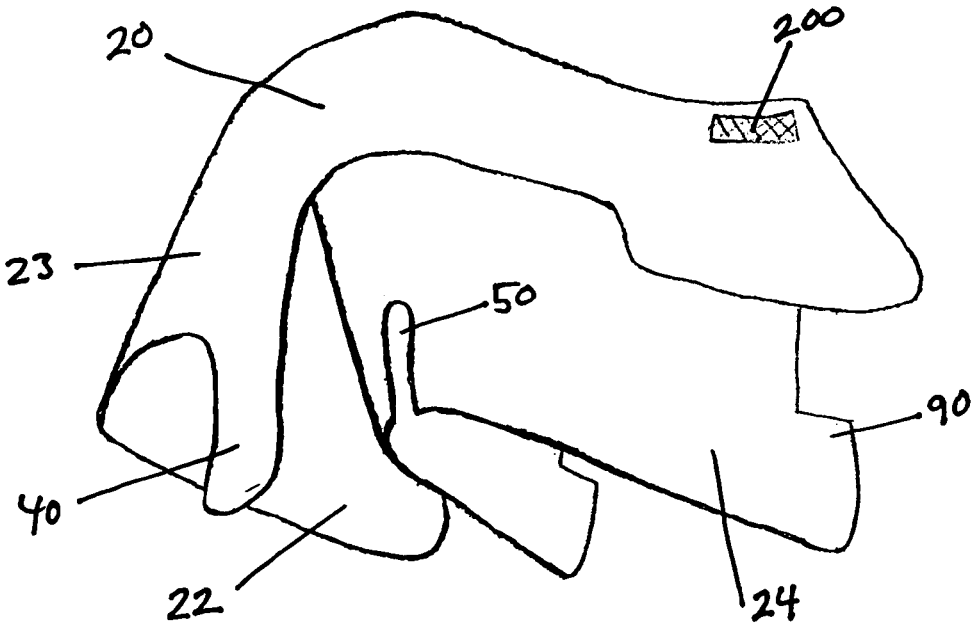
FIG. 3 is a bottom isometric view of a preferred embodiment of the invention

The following describe the preferred embodiment of the invention and variations of some additional embodiments. The preferred embodiment of the invention comprises generally of a U shaped body 20, constructed to generally fit the contour of a rear part of a shoe 10. The body has a top portion, 26 and an external portion 22 and internal portion 24 forming a cross section open at the bottom and closed at least along a portion of the top. The body is constructed to permit placement of the body on a rear part of a shoe so that the internal portion 24 lies within the shoe, and the external portion 22 lies outside of the shoe, as seen in FIG. 1. The body has a rear region 23 forming the bottom of the U and two side extensions 21 and 29, extending forwardly on each side of the rear portion. The purpose of the top portion 26 is to connect between the internal and external portions and may be ribbed or otherwise perforated if desired.

In the preferred embodiment, the body is constructed of semi-rigid, or resilient material, preferably smooth molded plastic offering little friction to an inserted foot. The rear region 23 of the internal portion 24 is formed to allow the ankle of a foot to easily fit therein, and thus forms a 'funnel' for the foot. In order to further ease the entry of a foot, at least one slot 50 is cut in the lower rear region of the internal portion. The slot allows the funnel to expand as the foot is inserted. A plurality of slots may be used. The problem of the narrowing of the shoe opening is therefore addressed, as the slot allows the device to expand when the foot is inserted into the shoe.

The funnel shape is further enhanced by biasing the rear internal portion forwardly. In addition, the forward biased eases removal of the device once the foot is inserted. However the forward bias enhances a tendency of the forward part of the device to dislodge itself from the shoe.

In order to prevent such dislodgement the preferred embodiment utilizes grip enhancers 250 located in the forward edges 100 of the side extensions 21 and 29. The grip enhancer may, by way of a non limiting example, be in the form of a stepped edge 90, cut into the forward edge and acting as a hook, or by cutting serrations in at least the internal part of the forward edges. The stepped edge acts as a hook and is constructed to engage the internal seam constructed at the top of the opening of most shoes. Serrations acts similarly by digging into the shoe to prevent dislodgement. Yet another embodiment of the grip enhancer may be created by adding a friction element such as foam, sandpaper, or forming such friction element in the body of the device (e.g. knurling or wavy edges)in the internal portion of the side extensions. To further enhance the grip enhancers, the forward edges of the side extensions are preferably elastically urged outward, thus forcing the grip enhancers into the internal sides of the shoe to increase their effectiveness. Such elastic urging prevents the device from dislodging after the shoe and the device are mated, but prior to insertion of the foot. Those skilled in the art will further recognize other embodiments of grip enhancers adapted to prevent unintentional dislodging of the device.

Figure 6:
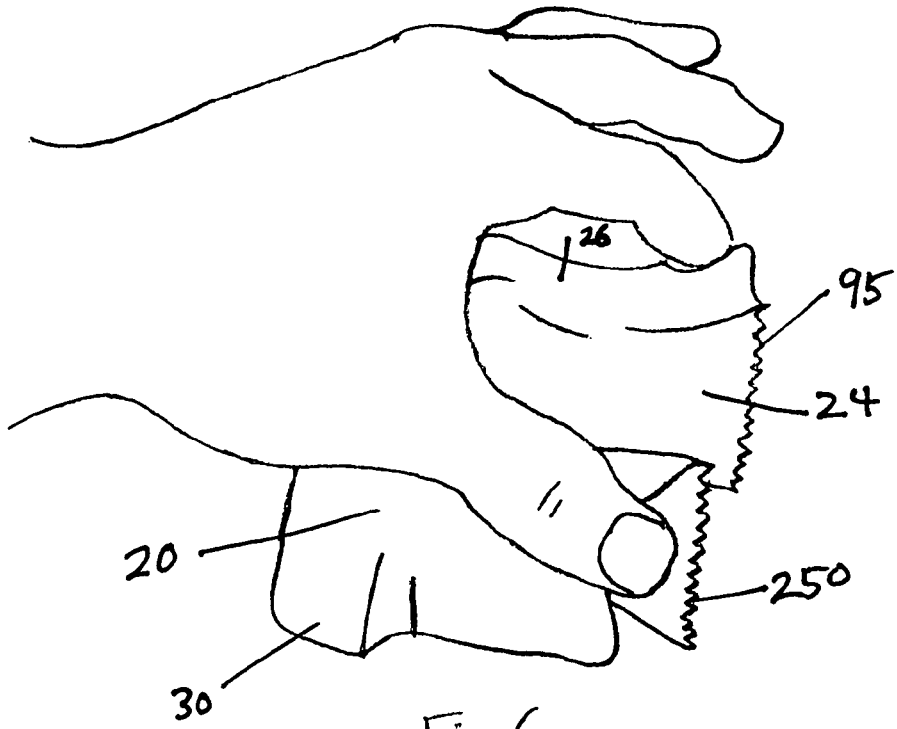
FIG. 6 depicts preparation for insertion of the device into a shoe.

To assist the insertion of the device into the shoe, prehensile finger grips 200 are preferably provided at the side extensions. Such finger grips may be created by extending the edges of the top external portion, as shown in FIG. 6 for example. Alternatively, the finger grips may be created by slots, protrusions, friction elements such as knurling, foam pads, sandpaper, or indentations, and the like, cut or formed in the external walls of the external portion of the side extensions, or by placement in any other convenient location in or on the side extensions, to permit the user to easily squeeze the side extensions and fit the device into a shoe. As the preferred embodiment is made of resilient material, or as other means may be used to allow the internal portion of the side extensions to snugly fit into the shoe, the finger grips allow the user to grasp the device, and squeeze the side extensions while more easily inserting the device into the shoe.

Once the foot is inserted into the shoe, the device is extracted. An extraction aid in the form of extraction points 30 is formed in one or preferably both sides of the rear region of the external portion. The extraction point is preferably formed by providing an offset leverage protrusion extending outwardly sideways from the body. The extraction point allows slipping another foot underneath the protrusion, or placing the extraction point on any convenient object such as a stool, reacher, box, and the like, and extracting the device by applying upward pressure thereto via the extraction point.

Optionally, a tab 40 in the rear region 23 of the external portion further facilitates insertion of the device into the shoe. It protrudes downward allowing the rear external portion to catch on the counter of the shoe. The tab depends downwardly from the top external portion, and extends below the lower portion of the internal portion. The tab bottom is preferably angled rearwardly from the body to ease the device insertion into the shoe. The tab may also be gripped by the user, or the tab may be hooked on any convenient object to facilitate the device removal.

Another extraction aid is preferably formed by providing at least one hole 150 in the top portion. The holes are dimensioned to receive a string that may be pulled, thus extracting the device. More preferably, two holes are formed to allow creation of a string loop.

In use the device is inserted into the shoe 10, optionally using the prehensile finger grips to squeeze and insert the device as seen in FIG. 6, so that the rear internal portion of the device is within the shoe, near the rear of the shoe opening, and the external portion extending outside the rear of the shoe. The side extensions 21 and 29 extend forwardly toward the front of the shoe. The shoe is placed on the floor (if not already there) and the users foot is inserted through the funnel formed by the internal portion. The side extension grip enhancers grip the shoe and prevent early extraction of the device. The slot 50 allows the funnel to expand to ease the insertion. The foot pushes the forwardly biased internal portion rearwardly, and thus the rear portion is rotated rearwardly to ease extraction. The device is extracted by any of the extraction aids described above.

It will be appreciated that the invention is not limited to what has been described hereinabove merely by way of example. While there have been described what are at present considered to be the preferred embodiments of this invention, it will be obvious to those skilled in the art that various other embodiments, changes, and modifications may be made therein without departing from the spirit or scope of this invention and that it is, therefore, aimed to cover all such changes and modifications as fall within the true spirit and scope of the invention, for which letters patent is applied.

What is claimed is:

1. A shoe donning aid comprising a generally U shaped body, having an external portion and an internal portion extending downwardly from a top portion, said external portion being spaced from said internal portion, said body constructed to permit its placement on a rear part of a shoe so that said internal portion, or a portion thereof, lies within the shoe, and said external portion, or a portion thereof, lies outside of the shoe, and a rear portion of the shoe protrudes between said external portion and said internal portion for preventing said body from migrating forwardly from said rear of the shoe;

said body having a rear region and two side extensions, each of said side extensions having at least one prehensile finger grip, for aiding in placing the shoe donning aid into a shoe; and, wherein said each of said side extensions further having at least one forward edge, comprising grip enhancer for enhancing the holding of the device within the shoe as a foot is inserted therein.

2. A shoe donning device as claimed in claim 1, wherein said grip enhancer comprises a stepped edge for engaging a contour at the top of a shoe opening.

3. A shoe donning device as claimed in claim 1, wherein said grip enhancer comprises serrations in said forward edge.

4. A shoe donning device as claimed in claim 1, wherein said grip enhancer is outwardly biased.

5. A shoe donning device as claimed in claim 1, wherein said grip enhancer comprises a friction element coupled to the internal portion of said side extension, or formed therein.

6. A shoe donning device of claim 1 further comprising a tab depending downwardly from said rear region and extending downwardly below the internal portion.

7. A shoe donning device of claim 1 further comprising of at least one offset leverage protrusions coupled to said external portion or formed therein, and extending outwardly sideways from the said rear region to form an extraction point.

8. A shoe donning device as claimed in claim 1, wherein said body or a portion thereof is made of resilient material.

9. A shoe donning device as claimed in claim 1, wherein said rear portion of the internal region is forwardly biased.

10. A shoe donning device as claimed in claim 1, wherein said rear region of the top portion is having a hole formed therein, said hole dimensioned for receiving a string.

11. A shoe donning device as claimed in claim 1, wherein said internal portion having a bottom rear region with at least one upwardly extending slot disposed therein.

12. A shoe donning aid comprising a generally U shaped body constructed of resilient material, and having an external portion and an internal portion extending downwardly from a top portion, said body constructed to permit placement of the body on a rear part of a shoe so that said internal portion lies within the shoe, and said external portion lies outside of the shoe, said body having a rear region and two side extensions;

said external portion having an external top region, and spaced from said internal portion for preventing said body from migrating forwardly from said rear of the shoe;

said internal portion having an internal top region, and an internal bottom region and further comprising at least one upwardly extending slot cut in its bottom rear region;

said side extensions each having forward edges wherein said forward edges comprise grip enhancements for enhancing the holding of the device within the shoe as a foot is inserted therein, and said side extensions further comprising prehensile finger grips coupled to said top portion; and, an extraction tab depending downwardly from said rear region of said external portion and extending downwardly below said internal bottom region.

13. A shoe donning device as claimed in claim 12, wherein said grip enhancements comprise a stepped edge for engaging a contour at the top of a shoe.

14. A shoe donning device as claimed in claim 12, wherein said grip enhancement comprise serrations in said forward edge.

15. A shoe donning device as claimed in claim 12, wherein said grip enhancer comprises a friction element coupled to the internal portion of said side extension, or formed therein.

* * * * *